US005757132A

United States Patent [19]

Matsuno et al.

[11] Patent Number: 5,757,132

[45] Date of Patent: *May 26, 1998

[54] DIELECTRIC BARRIER DISCHARGE LAMP

[75] Inventors: Hiromitsu Matsuno; Nobuyuki Hishinuma; Kenichi Hirose; Kunio Kasagi; Fumitoshi Takemoto; Yoshinori Aiura; Tatsushi Igarashi, all of Himeji, Japan

[73] Assignee: Ushiodenki Kabushiki Kaisha, Tokyo, Japan

[ * ] Notice: The term of this patent shall not extend beyond the expiration date of Pat. No. 5,666,026.

[21] Appl. No.: 725,039

[22] Filed: Oct. 2, 1996

[30] Foreign Application Priority Data

Oct. 2, 1995 [JP] Japan ..... 7-276194

[51] Int. Cl.[6] ..... H01J 61/067

[52] U.S. Cl. ..... 313/607; 313/234; 313/634; 313/249; 313/251

[58] Field of Search ..... 313/607, 234, 313/634, 249, 251, 618, 631, 632

[56] References Cited

U.S. PATENT DOCUMENTS 4,837,484 6/1989 Eliasson et al. ..... 313/634

5,581,152 12/1996 Matsuno et al. ..... 313/234

OTHER PUBLICATIONS

Discharge Handbook, Electrical Engineers Association, Jun. 1987, 7th Edition, pp. 262–271.

*Primary Examiner*—Nimeshkumar Patel

*Attorney, Agent, or Firm*—Sixbey, Friedman, Leedom & Ferguson; David S. Safran

[57] ABSTRACT

To maintain the relative positional relationship between an inner tube and an inner electrode of a dielectric barrier discharge tube having a roughly cylindrical, double tube arrangement of an outer tube coaxially arranged about an inner tube with a discharge space defined therebetween, an outer electrode on an outer surface of the outer tube, an inner electrode on an inner surface of the inner tube, and a discharge gas which forms excimer molecules by a dielectric barrier discharge filling said discharge space, despite repeated expansion and contraction of the inner electrode due to the dielectric barrier discharge lamp being repeatedly turned on and off, according to the invention, the inner electrode is formed of a substantially tubular metal component or the like, and a motion preventing component is provided at opposite ends of the inner electrode for maintaining an axial position of the inner electrode relative to the inner tube.

14 Claims, 2 Drawing Sheets

DIELECTRIC BARRIER DISCHARGE LAMP

BACKGROUND OF THE INVENTION

1. Field of the Invention

The invention relates to a so-called dielectric barrier discharge lamp which is used, for example, as an ultraviolet light source for a photochemical reaction, using light radiated from "excimer" molecules which are formed by a dielectric barrier discharge.

2. Description of Related Art

As generic art, for example, from Japanese patent disclosure document HEI 1-144560 or U.S. Pat. No. 4,837,484, a radiator, i.e., a dielectric barrier discharge lamp, is known in which a discharge vessel is filled which a gas which forms "excimer" molecules, and in which, by means of a dielectric barrier discharge, light is radiated from "excimer" molecules. This dielectric barrier discharge is also called an ozone production discharge or a silent discharge, as is described in the *Discharge Handbook*, Electrical Engineers Association, June 1989, 7th edition, page 263, Japan.

In the aforementioned publications, it is described that a roughly cylindrical discharge vessel functions at least partially also as the dielectric of the dielectric barrier discharge, furthermore, that the dielectric is permeable, and that light is radiated from the "excimer molecules".

Here, it is also described that an outer tube and an inner tube are arranged coaxially to one another as a double tube arrangement, that the outer surface of the outer tube is provided with a net-like electrode as one electrode, that the inner surface of the inner tube is provided with the other electrode by evaporation, and that in a discharge space between this outer tube and this inner tube the dielectric barrier discharge is carried out.

These dielectric barrier discharge lamps have advantages which neither conventional low pressure mercury lamps nor conventional high pressure arc discharge lamps have, for example, radiation of ultraviolet rays with short waves in which the primary wavelengths are 172 nm, 22 nm, and 308 nm, and furthermore selective generation of light with individual wavelengths which are roughly like line spectra with high efficiency.

Furthermore, they have the advantages that commercial quartz glass can be used for the discharge vessel, that the arrangement of the overall lamp is simple and that, thus, production can be easily achieved if its external shape is roughly cylindrical, and if the outer tube and the inner tube are arranged coaxially to one another, as was described above.

These conventional dielectric barrier discharge lamps, however, had the disadvantage that the inner electrode cannot be easily produced. Specifically, the inner tube, for example, has a diameter from 10 to 20 mm and a length from roughly 100 mm to 1000 mm. The evaporation work must be performed within this narrow space. Therefore, it was not possible to form a evaporation film with a uniform thickness. If in particular the thickness of the evaporation film is greater than or equal to 0.01 mm, the evaporation film loosens easily from the inner tube. Furthermore, in this case it was considered a disadvantage that the thickness of the evaporation film cannot be nondestructively checked, even if the evaporation film can be advantageously formed.

It is, therefore, also conceivable that the production of the inner electrode is not obtained by the evaporation film, but that the inner electrode is produced by inserting a tubular metal component into the inner tube. Specifically a tubular metal component with an outside diameter which is essentially identical to the inside diameter of the inner tube is inserted into the inner tube.

Furthermore, a metal component which has a gap in its longitudinal direction can be used to enhance the directly abutting arrangement of the inner electrode against the inner tube. In this way the width of this gap can be adjusted and its spring force used. See, the present applicants' commonly owned, co-pending U.S. patent application Ser. No. 08/530,655.

An inner electrode of this type, however, generally is formed of a metal, such as aluminum or the like, with a coefficient of thermal expansion which is much greater than the coefficient of thermal expansion of the quartz glass or ceramic which forms the discharge vessel. The inner electrode therefore expands more than the discharge vessel, even if the two have the same temperature increase.

Furthermore, contraction occurs when, proceeding from this state, the inner electrode is cooled. If, in this case, the contraction takes place from the two ends in the state in which the center area of the inner electrode is attached, the relative positional relationship between the inner electrode and the discharge vessel does not change. However, in the case in which one end of the inner electrode is attached and if in this state contraction of the other end occurs, the relative positional relationship between the inner electrode and the discharge vessel changes and as a result there are also cases in which the inner electrode moves in the inner tube and jumps out of the discharge vessel, the discharge becoming inherently unstable and there arising considerable danger, since generally high voltage is applied to the electrode.

SUMMARY OF THE PRESENT INVENTION

Therefore, a primary object of the present invention is to prevent, in a dielectric barrier discharge lamp, the inner electrode from moving in the inner tube and the relative positional relationship between the inner electrode and the discharge vessel from being destroyed, even if the dielectric barrier discharge lamp is repeatedly turned on and off and the inner electrode repeatedly expands and contracts as a result.

This object is achieved according to the invention by that fact that, in a dielectric barrier discharge lamp which has a roughly cylindrical, double tube arrangement, by a coaxial arrangement of an outer tube and an inner tube, in which the outer surface of this outer tube is provided with an electrode, in which the inner surface of the inner tube is provided with an inner electrode as the other electrode, and in which a discharge space between this outer tube and this inner tube is filled with a discharge gas which forms "excimer molecules" by a dielectric barrier discharge, the above described inner electrode is a tubular metal component, and that a component for preventing motion of the inner electrode is provided on both ends thereof.

The object of the invention is, furthermore, achieved by the fact that the inner electrode, in place of a tubular metal component, is formed of a metal component provided with a gap which extends in an axial direction of the inner tube.

The object of the invention is also achieved by the fact that the inner electrode, in place of the tubular metal component, is formed of two semicircular components, and that there are intermediate spaces located between them.

The object of the invention is, moreover, achieved by the fact that the inner electrode, in place of the tubular metal component, is produced by bending a metal plate in the form of a tube, and that it is formed such that there is a partial overlap in this case.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
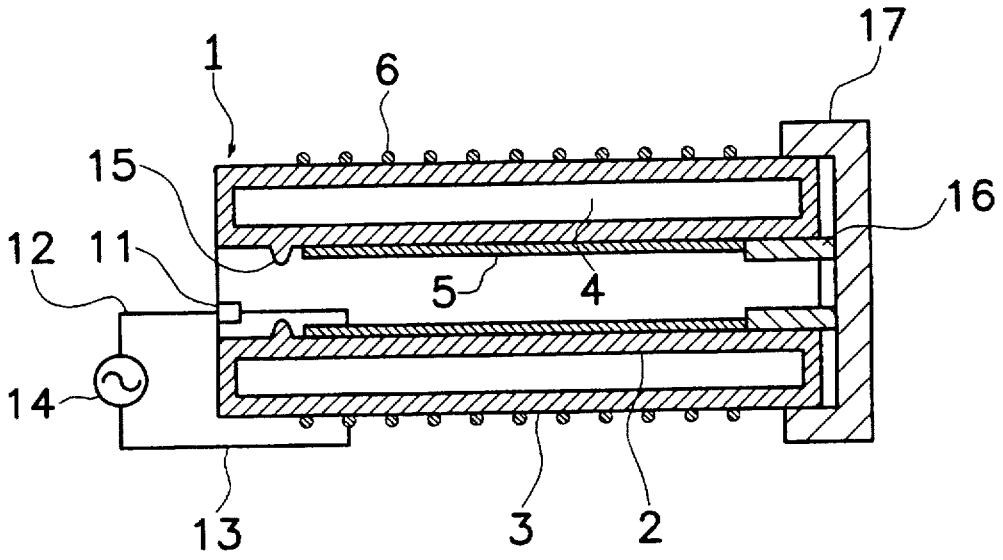
FIG. 1 shows a schematic cross-sectional view of a dielectric barrier discharge lamp according to the invention.

As shown in FIG. 1, discharge vessel 1 has a double tube arrangement in which inner tube 2 and outer tube 3 are arranged coaxially with respect to one another and are formed of synthetic quartz glass. The gap between the opposite ends of inner tube 2 and outer tube 3 is sealed, forming a discharge space 4 between them. Xenon gas, for example, is encapsulated at a pressure of 40 kPa in discharge space 4 as the discharge gas.

In this case, the inner tube 2 is a light reflection disk, and at the same time, is provided with an inner electrode 5 which acts as the electrode for the dielectric barrier discharge. This inner electrode is made, for example, out of an aluminum tube and has a total length of 300 mm, an outside diameter of 16 mm, and a thickness of 1 mm.

Outer tube 3 functions as both a dielectric of the dielectric barrier discharge and also as a light exit window, and its exterior is provided with an outer electrode 6. The outside diameter of the outer tube 3 is 24.5 mm and its thickness is 1 mm. Outer electrode 6 can be formed of metal wire that has been knitted seamlessly and cylindrically, and the discharge vessel 1 is inserted therein. Outer electrode 6 has a net-like shape, and light can be radiated through the mesh.

In discharge space 4, there is a getter with barium as the main component. This getter eliminates impurity gases within the discharge space 4 (for example, water) and stabilizes the discharge.

Figure 2:
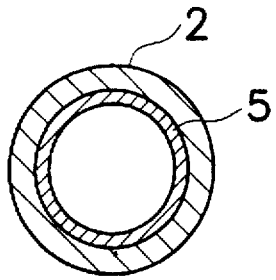
FIG. 2 shows a schematic of a first example of an inner electrode of the dielectric barrier discharge lamp of FIG. 1.

FIG. 2 shows an inner electrode 5 on the inside of inner tube 2 which is formed of a tubular metal component. For advantageous generation of the discharge in discharge space 4, it is desirable for the inner electrode 5 to be arranged tightly against the inside of inner tube 2. It is, therefore, necessary that the outside diameter of the tubular metal component forming the inner electrode 5 be identical to the inside diameter of the inner tube 2.

A lead wire connects inner electrode 5 via a solderless connection component 11 to a high voltage line 12. Furthermore, outer electrode 6 is provided with low voltage line 13. High voltage line 12 and low voltage line 13 are connected to current source 14. Low voltage line 13 is grounded if necessary.

A projection 15 is formed in inner tube 2 as a component to prevent axial movement of inner electrode 5. This means that the inner electrode is prevented from moving in the inner tube and the positional relationship is prevented from being destroyed even if the lamp is turned on and off repeatedly, since projection 15 plays the part of controlling the expansion and contraction of the inner electrode. Furthermore, by catching on the projection 15, projection 15 can prevent the inner electrode 5 from jumping to the outside even if the operator unintentionally carries the lamp by the high voltage line 12.

This projection 15 can be produced beforehand when inner tube 2 is produced. However, a process is also possible in which a component which differs from the inner tube is installed after the lamp is completed.

On the side opposite projection 15, a component 16, carried by a base 17, is provided for preventing motion of the inner electrode 5 away from the projection 15. This motion preventing component 16 is formed, for example, of quartz glass that has been shaped into a hollow cylindrical piece that has an outside diameter of, e.g., 13.5 mm and a thickness of, e.g., 1 mm. Component 16 is positioned within the discharge vessel 1 by the base 17 which is attached on the discharge vessel 1, for example, by means of an inorganic adhesive.

By suitably establishing the length of the motion preventing component 16, together with the projection 15, the objective of controlling the expansion and contraction of the inner electrode, even when the lamp is turned on and off repeatedly, is likewise achieved.

By means of the above described measure by which expansion and contraction of the inner electrode, which occurs on both ends of inner electrode 5 due to repeated turning on and off of the lamp, are suppressed, the relative positional relationship of the inner electrode with respect to the inner tube can always be fixed, and an advantageous discharge can always be produced.

Furthermore, very little work is required to insert the motion preventing component 16 after the inner electrode 5 has been inserted in the inner tube 2.

Next, an example is shown in which a metal component with a gap in the longitudinal direction is used for the inner electrode 5' instead of the tubular metal component of FIG. 2.

Figure 3:
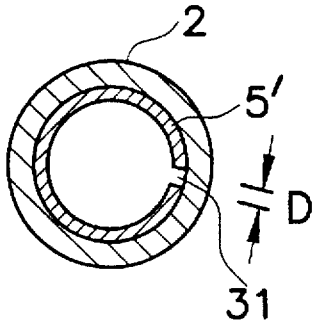
FIG. 3 is a view corresponding to that of FIG. 2, but showing a second example of the inner electrode of the dielectric barrier discharge lamp according to the invention.

FIG. 3 schematically shows such an arrangement of a split inner electrode 5' in the inner tube 2 which is produced, for example, by bending of an aluminum foil sheet with a thickness of 0.15 mm, and a width which leaves an intermediate gap 31 having a distance D between the longitudinal edges of the bent sheet of 0.9 mm. By means of this gap 31, the electrode can exert a spring force holding it tightly against the inner tube 2.

Even in the case of using the inner electrode in FIG. 3, by installing motion preventing part 16, it is possible to suppress axial shifting of the inner electrode due to expansion and contraction of the inner electrode 5' as a result of repeated turning on and off of the lamp. In this way, the relative positional relationship of the inner electrode 5' with respect to the inner tube 2 can always be fixed so as to produce an advantageous discharge.

If the width of gap 31 is excessive, the dielectric barrier discharge occurs more rarely, and the discharge become unstable. Specifically, if the width of gap 31 is less than or equal to 3.0 mm, a uniform discharge can be obtained.

Next, an example is shown in which two semicircular metal components are used as the inner electrode instead of the tubular metal component of FIG. 2 or the split tube of FIG. 3.

Figure 4:
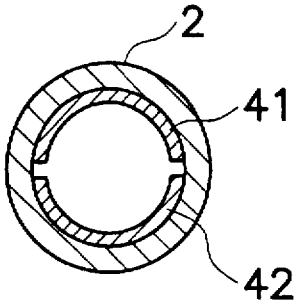
FIG. 4 shows a third example of the inner electrode of the dielectric barrier discharge lamp of FIG. 1.

FIG. 4 shows a cross sectional view of this third inner electrode. In this case, there are two semicircular electrodes 41, 42 with intermediate spaces 43, 44 located between them. These electrodes 41, 42 are pressed against inner tube 2 over its entire axial length by an elastic component (not shown). This elastic component can be a helical spring as shown and described in our above-mentioned, co-pending U.S. patent application Ser. No. 08/530,655, which is hereby incorporated by reference.

By inserting two semicircular metal components 41, 42 in the inner tube, in this way, by adjusting the bend of the semicircular metal components they can be easily placed tightly against the inner tube even if the inside diameter of the inner tube has slight deviations, i.e., is not uniform at all points. Therefore, power is supplied to the discharge space with high efficiency and mounting of the electrodes is simplified. These semicircular metal components are made, for example, of aluminum with a thickness of 0.5 mm and width which provides gaps between there facing longitudinal edges of, e.g., 0.4 mm.

Also, in the case of using the inner electrode in FIG. 4, by installing motion preventing component 16, it is possible to suppress axially shifting thereof due to expansion and contraction of the inner electrode caused by the lamp being repeatedly turned on and off. In this way, the relative positional relationship of the inner electrode 41, 42 with respect to the inner tube 2 can always be fixed and always produces an advantageous discharge.

Next, an example is shown in which a metal component which is produced by bending a metal plate in the form of a tube and which is formed such that a partial overlap is present is used for the inner electrode instead of the metal components described with respect to FIGS. 2–4.

Figure 5:
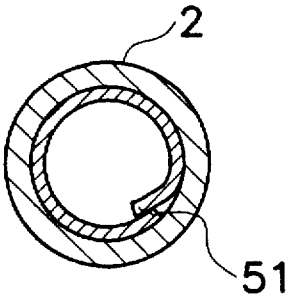
FIG. 5 is a another view similar to that of FIG. 2, but showing a fourth inner electrode of the dielectric barrier discharge lamp according to the invention.

FIG. 5 shows a cross sectional representation of such an inner electrode 51 which is formed, for example, by bending a metal plate, made of aluminum or the like, into the form of a tube shown in FIG. 5 in which there is a partial overlapping of the longitudinal edge portions of the metal plate. By means of this extremely simple arrangement, the inner electrode can be located tightly against the inside of the inner tube, and furthermore, it can be easily produced. In addition, by means of the extremely simple process in which the width of overlap of inner electrode 51 can be adjusted, good surface engagement of the inner electrode 51 with the inner tube 2 can be achieved even if the inner diameter of inner tube 2 possesses slight surface irregularities.

Also, in the case of using the inner electrode in FIG. 5, by installing the motion preventing component 16, it is possible to suppress axial shifting of the inner electrode due to expansion and contraction of the inner electrode which is caused by the lamp being repeatedly turned on and off. In this way, the relative positional relationship of the inner electrode with respect to the inner tube can always be fixed and so that an advantageous discharge is always produced.

The thickness of the inner electrode, in this embodiment, for example, is 0.08 mm. But, it is also sufficient for this thickness to be any value within the range from 0.03 mm to 0.1 mm.

This is because, at thicknesses greater than or equal to 0.03 mm, conductivity can be adequately guaranteed for purposes of discharge, even if the surface is corroded by ozone, and because at a thickness of less than or equal to 0.1 mm, the width of overlap 51 can be easily adjusted.

It is to be understood that although preferred embodiments of the invention have been described, various other embodiments and variations may occur to those skilled in the art. Any such other embodiments and variations which fall within the scope and spirit of the present invention are intended to be covered by the following claims.

We claim:

1. Dielectric barrier discharge tube comprising a roughly cylindrical, double tube arrangement having an outer tube coaxially arranged about an inner tube with a discharge space being defined therebetween, an outer electrode on an outer surface of the outer tube, an inner electrode on an inner surface of the inner tube, and a discharge gas which forms excimer molecules by a dielectric barrier discharge filling said discharge space; wherein said inner electrode is a tubular metal component formed of at least one metal plate which is positioned on the inner surface of the inner tube without being directly affixed thereto; and wherein a motion preventing component is provided at each of opposite ends of the inner electrode for maintaining an axial position of the inner electrode relative to the inner tube.

2. Dielectric barrier discharge tube according to claim 1, wherein the tubular metal component forming said inner electrode is provided with a gap which extends axially along the length thereof.

3. Dielectric barrier discharge tube according to claim 1, wherein the at least one metal plate forming said inner electrode comprises two substantially semi-cylindrical metal plates; and wherein an intermediate space is provided between each longitudinally extending edge of a first of said two semi-cylindrical metal plates and a respective, facing longitudinally extending edge of a second of said two semi-cylindrical metal plates.

4. Dielectric barrier discharge tube according to claim 1, wherein the at least one metal plate is a single plate which has been bent into the shape of a tube in which opposite longitudinal edge portions of the sheet overlap each other.

5. Dielectric barrier discharge tube according to claim 1, wherein the tubular metal component forming said inner electrode is circumferentially continuous.

6. Dielectric barrier discharge tube comprising a roughly cylindrical, double tube arrangement having an outer tube coaxially arranged about an inner tube with a discharge space being defined therebetween an outer electrode on an outer surface of the outer tube an inner electrode on an inner surface of the inner tube, and a discharge gas which forms excimer molecules by a dielectric barrier discharge filling said discharge space; wherein said inner electrode is a tubular metal component; wherein a motion preventing component is provided at each of opposite ends of the inner electrode for maintaining an axial position of the inner electrode relative to the inner tube; and wherein the motion preventing component at a first axial end of the inner electrode comprises a hollow cylindrical glass piece positioned within the discharge vessel.

7. Dielectric barrier discharge tube according to claim 6, wherein the hollow cylindrical glass piece is positioned within the discharge vessel by a base which is attached over an end of the discharge vessel.

8. Dielectric barrier discharge tube according to claim 7, wherein the base is attached to the discharge vessel by an inorganic adhesive.

9. Dielectric barrier discharge tube according to claim 7, wherein the motion preventing component at a second axial end of the inner electrode comprises a projection formed on an inner surface of the inner tube.

10. Dielectric barrier discharge tube according to claim 9, wherein said projection is an annular ridge formed as part of said inner tube.

11. Dielectric barrier discharge tube according to claim 7, wherein the tubular metal component forming said inner electrode is provided with a gap which extends axially along the length thereof.

12. Dielectric barrier discharge tube according to claim 7, wherein the tubular metal component forming said inner electrode is formed of two substantially semi-cylindrical parts; and wherein an intermediate space is provided between each longitudinally extending edge of a first of said two semi-cylindrical parts and a respective, facing longitudinally extending edge of a second of said two semi-cylindrical parts.

13. Dielectric barrier discharge tube according to claim 7, wherein the tubular metal component forming said inner electrode is formed of a metal plate which has been bent into the shape of a tube in which opposite longitudinal edge portions of the sheet overlap each other.

14. Dielectric barrier discharge tube according to claim 7, wherein the tubular metal component forming said inner electrode is circumferentially continuous.

* * * * *